United States Patent [19]

Yamashita

[11] 4,034,221

[45] July 5, 1977

[54] CHARGING DEVICE FOR AUTOMATIC COPYING APPARATUS

[75] Inventor: Tadashi Yamashita, Yokohama, Japan

[73] Assignee: Ricoh Co., Ltd., Japan

[22] Filed: Mar. 31, 1976

[21] Appl. No.: 672,236

[30] Foreign Application Priority Data

Apr. 7, 1975 Japan ..... 50-41185

[52] U.S. Cl. ..... 250/324; 250/325

[51] Int. Cl.² ..... G03G 15/00

[58] Field of Search ..... 250/324, 325, 326; 317/262 A

[56] References Cited

UNITED STATES PATENTS

| | | | |
|---|---|---|---|
| 3,307,034 | 2/1967 | Bean | 250/326 |
| 3,749,927 | 7/1973 | Sato | 250/325 |
| 3,778,623 | 12/1973 | Sato | 250/325 |
| 3,816,749 | 6/1974 | North | 250/324 |

*Primary Examiner*—Craig E. Church

*Attorney, Agent, or Firm*—McGlew and Tuttle

[57] ABSTRACT

The charging device for automatic copying apparatus comprises charging wires supplied with a charge voltage at all times and a plurality of lamps disposed in the rearward position of the charging device. As turning on of the lamps can prevent the photoconductor from charging by the charging wires, a charged zone corresponding to the effective image region can be produced on the photoconductor by controlling turning on and off of the lamps.

9 Claims, 7 Drawing Figures

For B4 type sheet

For A4 type sheet

CHARGING DEVICE FOR AUTOMATIC COPYING APPARATUS

BACKGROUND OF THE INVENTION

This invention relates to a charging device for automatic copying apparatus of the type which comprises charging wires arranged in a charger case, and a charging circuit for supplying a charge voltage to the charging wires.

Increased industrial activities have in recent years brought about a marked increase in the amount of information handled within a business unit or between business units. This has created a demand for copying apparatus capable of operating at increased speed in connection with propagation of information carried out by using paper as a medium of communication.

In automatic copying apparatus commercially available nowadays, the charging device used as means for charging the surface of a photoconductor usually operates such that charging is effected intermittently in preparation for imagewise exposure to radiation of the photoconductor. This requires the provision of a relatively complex circuit. At the same time, there is the problem of difficulty being encountered in accomplishing instantaneous actuation of the charging device when charging is to be performed. This problem is raised because it is impossible to reduce beyond a certain limit the time interval for the charging wires to respond to ON and OFF signals due to electrical inertia, hysteresis and energization of the charger. Thus, intermittent charging has hitherto been one of the factors concerned in hampering realization of high speed document copying. To obviate the above-described disadvantages of the prior art, proposals have been made to perform charging continuously and remove by means of a lamp, immediately before the exposed photoconductor is introduced into the developing station, the unnecessary charge carried by the non-image region which was not discharged at the time the photoconductor was exposed to an optical image of an original. This system has disadvantages in that a mechanism of complex construction is required which occupies more space than the usual system and that the residual potential is high.

SUMMARY OF THE INVENTION

This invention has as its object the provision of a charging device for copying apparatus which eliminates the above-described disadvantages of the prior art and enables the copying apparatus to perform at increased speed.

The outstanding characteristics of the invention are that a suitable number of lamps are disposed in the rearward position of the charger, a charge voltage is impressed on the charging wires at all times, and turning on and off of the lamps are controlled such that the charged zone of the photoconductor is made to correspond to the effective image region.

Other and additional objects, features and advantages of the invention will become evident from the description of a preferred embodiment of the invention when considered in conjunction with the accompanying drawings.

DETAILED DESCRIPTION

Figure 1:
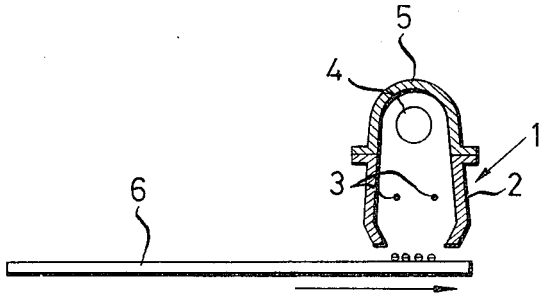
FIG. 1 and FIG. 2 are views in explanation of the manner of operation of the device according to the invention in which control of charging is effected.
Figure 2:
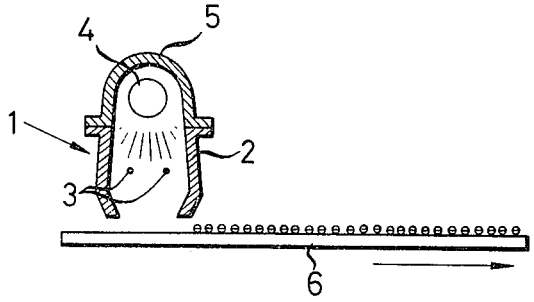

A preferred embodiment of the invention will now be described with reference to the drawings. Referring to FIG. 1 and FIG. 2, a charger 1 comprises a charger case 2 in which charging wires 3 are arranged. Lamps 4 and reflectors 5 therefor are arranged in a rearward portion of the charger 1. While the copying apparatus is in operation, a high voltage is impressed on the charging wires 3 at all times so that the charging wires will continuously charge. If the lamps 4 are off as shown in FIG. 1 when a photoconductor 6 moves past an opening of the charger case 2 in the direction of an arrow, the surface of the photoconductor 6 will be charged. If the lamps 4 are on as shown in FIG. 2, the surface of the photoconductor 6 will not be charged. It will be seen that, in spite of the fact that the charging wires 3 are charging at all times, it is possible to limit the charged zone on the surface of the photoconductor 6 by controlling the turning on and off of the lamps 4.

Figure 3:
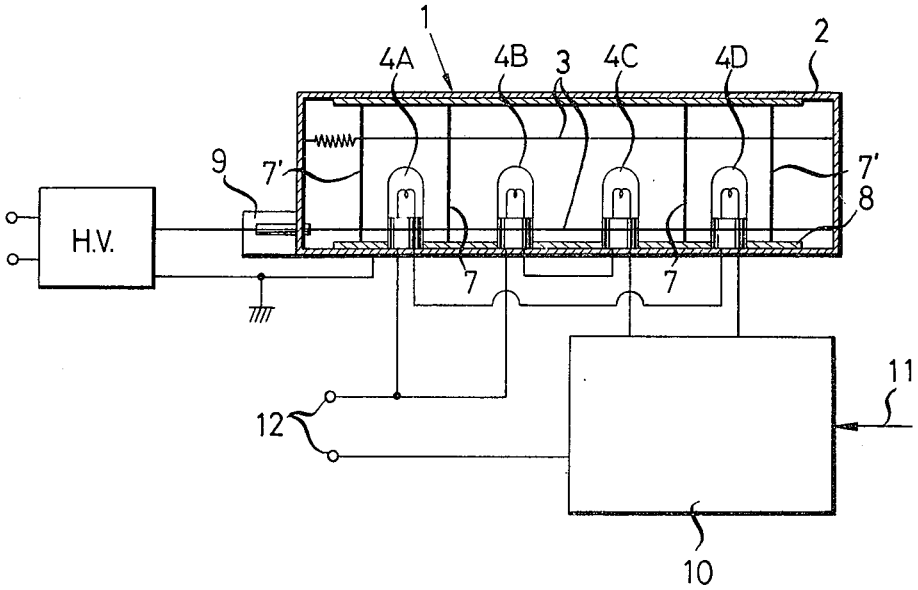
FIG. 3 is a bottom plan view of the device according to the invention.

Referring to FIG. 3, two lamps 4A and 4D are arranged on opposite sides respectively and two lamps 4B and 4C are disposed in the center, with light intercepting plates 7 and 7 being provided between lamps 4A and 4B and between 4C and 4D respectively so as to avoid invasion of the adjacent sections by the light. Additional light intercepting plates 7′ and 7′ are provided on the outer sides of lamps 4A and 4D respectively. The spacing between light intercepting plates 7 and 7 is equal to the width of paper of the A type, while the spacing between light intercepting plates 7′ and 7′ is equal to or slightly larger than the width of paper of the B type. The A and B types represent the standards of the sizes of printing paper produced in Japan. The numeral 8 designates earth electrodes, while the numeral 9 is a connecting terminal for the charging wires 3.

When transfer printing sheets are used, it is advantageous to effect control of the lamps in accordance with the size of the particular transfer printing sheet used. The reason for this is as follows: if the transfer printing sheet is smaller in size than the original to be copied, toner particles will adhere to those portions of the photoconductor which are not printed on the transfer printing sheet, thereby wasting the toner and making the cleaner ineffective; if the transfer printing sheet is larger in size than the original, no trouble will be caused by charging the photoconductor in accordance with the size of the transfer printing sheet. In the present invention, when transfer printing sheets are used, the image region corresponding to the size of the transfer printing sheets may be referred to as an effective image region.

In the embodiment shown in FIG. 3, let us assume that charging is effected by the charging of charging wires 3 on the surface of the photoconductor 6 such that the charged region corresponds in maximum dimension to the width of paper of the B type, and that transfer printing sheets are used. When the transfer printing sheets are of the B type, charging of the photoconductor is carried out by turning off all the lamps 4A to 4D. However, in the event the transfer printing sheets are of the A type, the charge carried by those portions of the photoconductor which are disposed outside the widthwise edges of the A type sheets are removed by turning on lamps 4A and 4D. As the photoconductor moves forwardly, all the lamps 4A to 4D are turned on when regions of the photoconductor 6 other that the effective image regions are indexed with the charging wires 3, regardless of whether the transfer printing sheets are of the A type or B type. Thus, charging of non-image regions of the photoconductor is avoided till the next following image forming region is brought into index with the charging wires 3.

Figure 4:
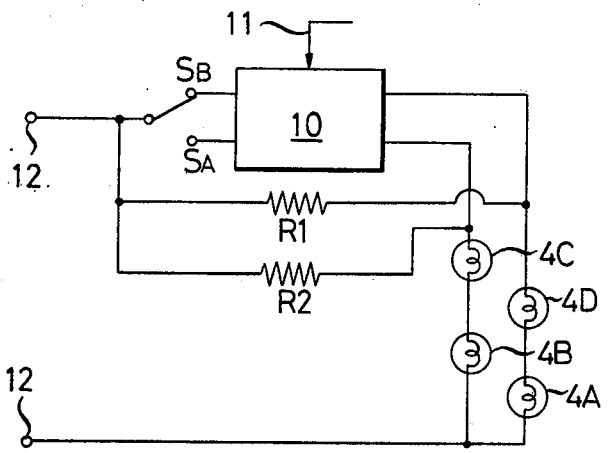
FIG. 4 is a diagram showing the control circuit used in the invention.

Referring to FIG. 4, an electric current is passed to the lamps 4A to 4D through resistors R1 and R2 upon the main switch of the copying apparatus being turned on. Although the electric current has a value which is lower than the level required for providing an radiation, it might be said that this places the lamps in a condition in which they are ready to act when necessary. Thus, by applying a slightly higher voltage, it is possible to cause the lamps to emit light of sufficiently great lumens to radiate the photoconductor. By this arrangement, it is possible to effect switching of the lamps from the non-radiating condition to the radiating condition or vice versa in microseconds. In FIG. 4, $S_A$ and $S_B$ are switches for paper of the A type and B type respectively, 10 is a logic circuit, 11 is a pulse input section and 12 is a terminal of the power source.

Figure 5:
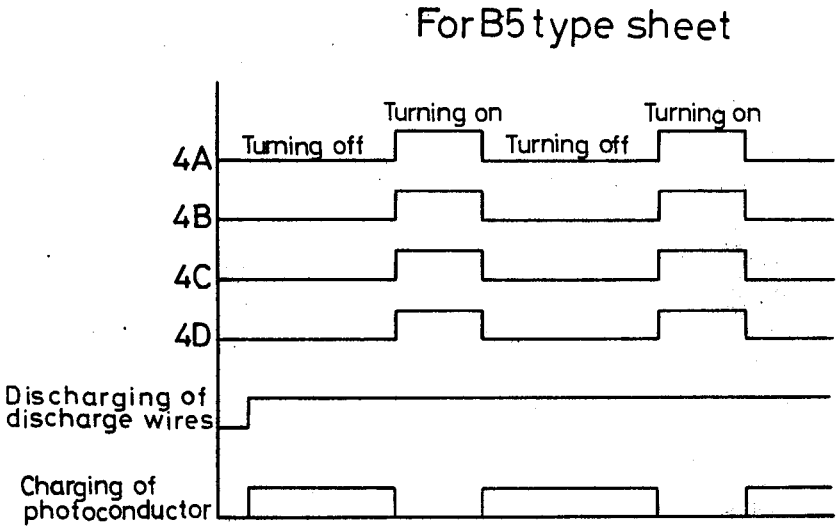
FIG. 5 to FIG. 7 are graphs showing the examples of timing for turning on and off the lamps and the charging wires.
Figure 6:
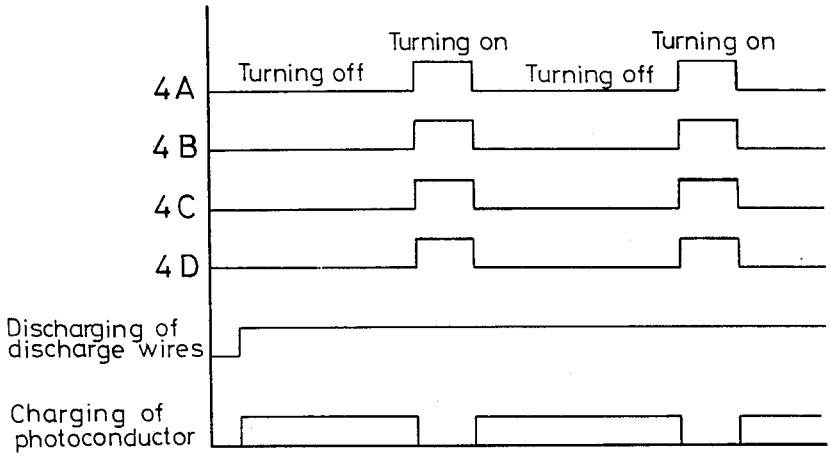

When the transfer printing sheets are of the B type, switch $S_B$ is brought to an ON position as shown in FIG. 4. As the printing switch of the copying apparatus is turned on, the charging wires 3 begin to charge and charging is sustained while the printing switch remains in an ON position. Then the photoconductor initiates its operation and causes a pulse signal generator to generate a pulse which appears in the input section 11. As a result, the logic circuit acts to turn off all the lamps 4A to 4D which have remained in the ON position up to that time, whereby the photoconductor is charged on a portion thereof which corresponds in width to paper of the B type. The pulses are generated for a time interval during which the photoconductor moves a distance corresponding to the length of the particular transfer printing sheets, so that a charged region is formed on the photoconductor which corresponds to the size of the transfer printing sheet or the effective image region. After lapse of the time required for the photoconductor to move the distance corresponding to the length of the effective image region, generation of the pulses terminates. This turns on all the lamps 4A to 4D again, thereby interrupting the formation of the charged region on the photoconductor. Thus, when the transfer printing sheets are of the B5 type, the lamps 4A to 4D are relit earlier than when the transfer printing sheets are of the B4 type. FIG. 5 and FIG. 6 are graphs showing the timing for turning on and off of the lamps and charging of the charging wires 3 for the transfer printing sheets of the B5 and B4 types respectively. It will be appreciated from these figures that the charging wires charge at all times, that all the lamps are turned on and off with the same timing, the time during which the lamps are in an OFF condition is longer when the transfer printing sheets are of the B4 type than when they are of the B5 type, and that consequently the charged region of the photoconductor is greater in size when the transfer printing sheets are of the B4 type than when they are of the B5 type. (Sheets of the B4 type and the B5 type have the same width and sheets of the B4 type are greater in length than those of the B5 type.)

Figure 7:
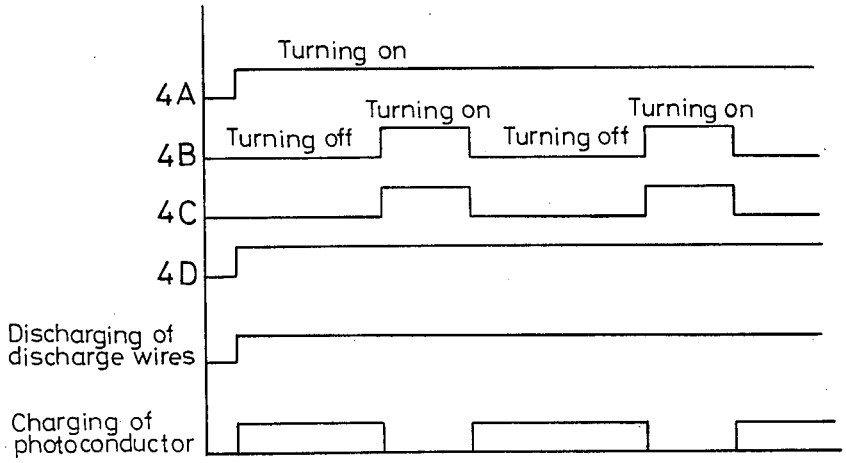

When the transfer printing sheets are of the A type, switch $S_A$ is brought to an ON position, thereby bringing lamps 4A and 4D to an ON condition at all times and causing lamps 4B and 4C to be alternately turned on and off. FIG. 7 is a graph showing the timing for transfer printing sheets of the A4 type.

While the invention has been described with reference to the copying apparatus of the type which use transfer printing sheets, it is to be understood that the invention can have application in apparatus in which an image is directly formed on photoconductive sheets. If this is the case, turning on and off of the lamps is controlled in accordance with the size of the image region of the original to be reproduced. That is, the effective image region may vary depending on the size of the image region of the original to be reproduced.

From the foregoing description, it will be appreciated that the charger is performing a charging operation at all times according to the invention. This makes the automatic copying apparatus having the charging device according to the invention suitable for high speed duplication of the original. Moreover, since the charged region of the photoconductor can be determined by controlling the turning on and off of the lamps at the same time as charging is effected, the charging device according to the invention is more advantageous than the charging device of the prior art in which the entire surface of the photoconductor is charged and the charge is removed by discharging from those portions of the photoconductor which need not have a charge, because residual potential is lower in the former than in the latter. An additional advantage of the invention is that, since the charger and the lamp mechanism can be formed as a unit, it is possible to obtain an overall compact size in a charging device for automatic copying apparatus. The charger case can serve concurrently as light intercepting plates, so that simplification of the mechanism can be promoted. The present invention is conducive to reduced consumption of the developing agent and reduced workload at the cleaning station, because charging of the photoconductor is effected only in the required region thereof. In accordance with the invention, the lamps are placed in a standby position at all times by passing a current thereto as a preliminary operation. This enables the lamps to respond to the signals more quickly than is possible in the prior art device.

What I claim is:

1. A charging device for automatic copying apparatus comprising:

a. a charger case;

b. charging wires arranged in said charger case;

c. a charging circuit for supplying a charge voltage to said charging wires, said charging circuit impressing a charge voltage to said charging wires at all times while copying condition of the apparatus;

d. a plurality of lamps disposed in the rearward position of the charger case; and e. a control circuit turning on and off said lamps so as to bring the charged zone of a photoconductor into agreement with the effective image region.

2. A charging device as claimed in claim 1 further comprising a plurality of light intercepting plates spaced apart arranged in said charger case from one another suitable distances in a direction lateral to the direction of movement of the photoconductor to divide said lamps into several groups, so that the charged region of the photoconductor widthwise of the photoconductor relative to its direction of movement can be controlled by controlling the turning on and off of the lamps of different groups, and the charged region of the photoconductor in the direction of its movement can be controlled by effecting control of the turning on and off of the lamps disposed in a position corresponding at least to the charged region.

3. A charging device as claimed in claim 2, wherein a electric current is passed at all times to said lamps while the copying apparatus is in operation, said electric current having a value such that the lamps do not emit light and do not interfere with charging of the photoconductor.

4. A charging device as claimed in claim 1, wherein turning on and off said lamps is controlled in accordance with the size of the transfer printing sheet used.

5. A charging device for automatic copying machines, comprising a charging case, charge wire means in said case providing a continuous charge along a predetermined length of said case, a plurality of lamps arranged in spaced relationship along said predetermined length in said case, at least one light interrupt plate disposed between at least two adjacent lamps, and means connected to said lamps to selectively turn selective ones of said lamps on during operation of said charge wire means to limit the effective charging zone thereof within said predetermined length.

6. A charging device according to claim 5, wherein said case predetermined length includes at least one central zone having at least one lamp and at least one zone on each side of said central zone having at least one lamp and wherein said at least one light interrupt plate includes a separate plate disposed between said central and side zone.

7. A charging device according to claim 6, including a light interrupt plate arranged at each end of said predetermined length, said means connected to said lamp to turn them on including means for lighting the lamps in said end zones for the copying of one size of paper and the lighting of the lamps in the central zone for the copying of another size of paper.

8. A charging device according to claim 8, wherein said means connected to said lamps to light them includes a power supply, a resistance connected in series from said power supply to said lamps in said central zone, a second resistance connected from said power supply to said lamps in said end zones, a logic circuit connected between said power supply and said lamps of said central zone and said end zones and having switch means for regulating which of the lamps are turned on during a charging cycle.

9. A charging device according to claim 5, wherein there are four lamps arranged along said predetermined length, said at least one light interrupting plate comprising a plate at each end of said predetermined length and between the two central lamps and each end lamp to divide said case into a central zone having two lamps and an end zone on each side of said central zone having a single lamp each, said means connected to said lamps comprising a separate connection to said lamps in said end zone for lighting them separately from said lamps in said central zone, and switch means for selecting which of the central and two end zones will be connected for lighting.

* * * * *